United States Patent [19]

Humphrey

[11] 4,071,134

[45] Jan. 31, 1978

[54] TYPING ERROR CORRECTION DEVICE

[76] Inventor: Frederick Harold Humphrey, 7 Orchard St., Markham, Ontario, Canada, L3P 2S9

[21] Appl. No.: 660,835

[22] Filed: Feb. 24, 1976

[51] Int. Cl.[2] ..... B41J 29/36

[52] U.S. Cl. ..... 197/181; 197/157

[58] Field of Search ..... 197/151, 156, 157, 159, 197/172, 181; 242/197, 75

[56] References Cited

U.S. PATENT DOCUMENTS

| | | | |
|---|---|---|---|
| 1,183,424 | 5/1916 | Baldwin | 197/181 |
| 2,815,110 | 12/1957 | Carlson | 197/151 |
| 3,205,997 | 9/1965 | Przybylowicz | 197/151 |
| 3,834,512 | 9/1974 | Haugen | 197/181 |
| 3,877,561 | 4/1975 | Guerrini et al. | 197/151 |

FOREIGN PATENT DOCUMENTS

| | | | |
|---|---|---|---|
| 1,071,959 | 6/1967 | United Kingdom | 197/181 |

*Primary Examiner*—Paul T. Sewell

*Attorney, Agent, or Firm*—Sim & McBurney

[57] ABSTRACT

An apparatus for use with a typewriter is described. The apparatus is adapted to be utilized with a variety of typewriters, regardless of typewriter configuration, and permits a correcton ribbon or tape to be fed through the standard ribbon guide between the inked ribbon and the platen. The apparatus includes two spool housings, one on either side of the typewriter, each housing being capable ofl attachment to the typewriter housing as by double-faced adhesive tape. Each housing has a pivotally mounted guide portion defining an edge around which the ribbon can bend, to allow the correction ribbon to be directed horizontally across the typewriter from one housing to the other.

5 Claims, 6 Drawing Figures

TYPING ERROR CORRECTION DEVICE

This invention relates generally to the correction of typing errors, and has to do particularly with an apparatus which may be applied and affixed to most standard typewriters, and which is adapted to permit the typist to correct typing errors in a convenient manner.

DESCRIPTION OF THE PRIOR ART

The prior art discloses certain special typewriter constructions which incorporate within their structure a reel or spool of correction tape, together with special wire-type guides, indexing friction means for indexing the correction tape forward each time it is used, and so forth. U.S. Pat. No. 3,204,746 Wolowitz, patented Sept. 7, 1965, is exemplary in this regard.

An obvious disadvantage of a construction which requires all of the additional components to be incorporated directly into the initial construction of the typewriter at the time it is put together, is than any person who wishes to enjoy the advantage of such automatic typing error correction means much purchase an entire new typewriter in order to do so.

Accordingly, it is an aspect of this invention to provide an typing error correction apparatus consisting of components which may be readily and easily applied and affixed to the outer cover of almost all existing typewriters, so as to make it unnecessary for a typewriter user to make a large outlay of funds to purchase an entire new typewriter in order to enjoy the benefit of the invention.

GENERAL DESCRIPTION OF THE INVENTION

In the development of the present invention, it was considered that the existing need was for an error correction device which could be readily affixed to virtually any conventional existing typewriter, and which did not require the user to take the existing typewriter apart in order to carry out the attachment. Indeed, because of the great variety of internal typewriter constructions available on the market, it would be extremely difficult if not impossible to arrive at a universally applicable attachment construction which could be accepted and attached inside the covers of all existing typewriters.

Accordingly, it was determined that, in order to find wide acceptability, any typing error correction attachment should be adapted to be secured against the outside of the typewriter cover, and this constitutes an aim of the present invention.

The difficulties do not disappear upon such determination, however, because typewriter top covers have many shapes; some with straight sides, some sloped, some flat, and some curved. Certain typewriters have ample clearance between the cover and the platten, but others are fitted with little clearance. It is a further aim of this invention to overcome the problem of virtual universal adaptability of a typing error correction attachment to the outside of existing typewriters, regardless of the cover configuration.

Accordingly, this invention provides apparatus for use with a typewriter, comprising:

a first support means supporting a first spool for holding correction ribbon, the spool being mounted for rotation with respect to the first support means, first attachment means permitting the first support means to be affixed to the outer cover of a typewriter at one side thereof, a first ribbon guide pivotally mounted on said first support means, and having a first guide edge around which the ribbon can bend, whereby the orientation of said first guide edge can be manually determined, the first ribbon guide having visible alignment means to allow the user to know when the first guide edge is oriented perpendicular to a table surface supporting a typewriter to which the apparatus is affixed, a second support means supporting a second spool for receiving correction ribbon, the second spool being mounted for rotation with respect to the second support means, an indexing member adapted positively to rotate the second spool by increments, second attachment means permitting the second support means to be affixed to the outer cover of a typewriter at the other side thereof, and a second ribbon guide pivotally on said second support means, and having a second guide edge around which the ribbon can bend, whereby the orientation of said second guide edge can be manually determined, the second ribbon guide having visible alignment means to allow the user to know when the second guide edge is oriented perpendicular to a table surface supporting a typewriter to which the apparatus is affixed, each said support means including a housing which defines a protective compartment containing the respective spool, the correction ribbon having access to and egress from each compartment through an opening configured to allow unrestricted movement of the ribbon therethrough regardless of the angular orientation of the ribbon with respect to the housing, the respective guide edge for each support means being located outside of but adjacent to the respective said opening;

each said visible alignment means being constituted by an alignment finger extending perpendicular to the respective guide edge, whereby the alignment finger when oriented parallel to a table surface ensures that its respective guide edge is perpendicular to the table surface;

each ribbon guide being frictionally mounted to its respective support means such that it will remain in any orientation until torque is applied to change the orientation.

GENERAL DESCRIPTION OF THE DRAWINGS

One embodiment of this invention is illustrated in the accompanying drawings, in which like numerals denote like parts throughout the several views, and in which.

PARTICULAR DESCRIPTION OF THE DRAWINGS

Figure 1:
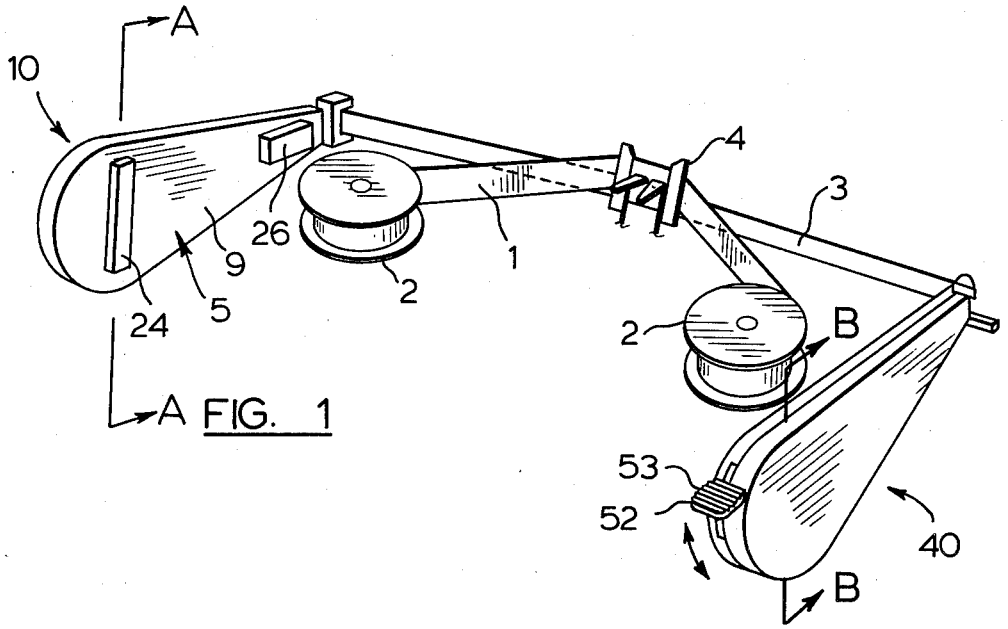
FIG. 1 is a perspective view of a typing error correction attachment.

Attention is first directed to FIG. 1, which illustrates all components of the typing error correction device of this invention, and also a standard part of a typical typewriter. In FIG. 1, a typing ribbon 1 is seen to be entrained around two ribbon spools 2. In the conventional typewriter construction, mechanism will be provided to cause the typing ribbon 1 to be pulled off one of the spools 2 and onto the other of the spools 2. In certain typewriters, the typing ribbon passes only once from one spool to the other, whereas in other typewriters mechanism is provided to allowing the type ribbon 1 to pass back and forth several times until the ink with which it is impregnated is substantially used up. In FIG. 1 the typing ribbon 1 passes through the standard typewriter ribbon guide 4, which forms a typical part of the conventional typewriter construction. Each time a key of the typewriter is struck, the ribbon guide raises the ribbon 1 upwardly so as to interpose the ribbon 1 between the type and the paper held against the platen. Upon release of the key, the guide 4 decends again to allow the typist to view what has been typed.

In most conventional typewriters it is possible to set the mechanism controlling the typewriter ribbon guide 4 in such a way that it can rise to one of two levels, the first level corresponding to the use of the upper half of the typing ribbon 1, the second level corresponding to the use of the lower half of the typing ribbon 1. This provision is made to allow the typist to utilize a two-colour ribbon, the colours typically being black and red. Ordinarily, the black half of a typing ribbon is located in the upper half when it is strung through the typewriter ribbon guide 4, and since black is the usual type colour, the common setting for the level to which the typewriter ribbon guide 4 rises is that which brings the black half of the typing ribbon between the type and the platten.

This invention takes advantage of the fact that the lower half (typically the red half) of the typing ribbon 1 is ordinarily unused. As seen in FIG. 1, an error correction ribbon 3 is fed through the typewriter ribbon guide on the far side of the typing ribbon 1 as seen in FIG. 1, which means that the error correction ribbon 3 is interposed between the typing ribbon 1 (the lower half) and the platen of the typewriter.

Figure 2:
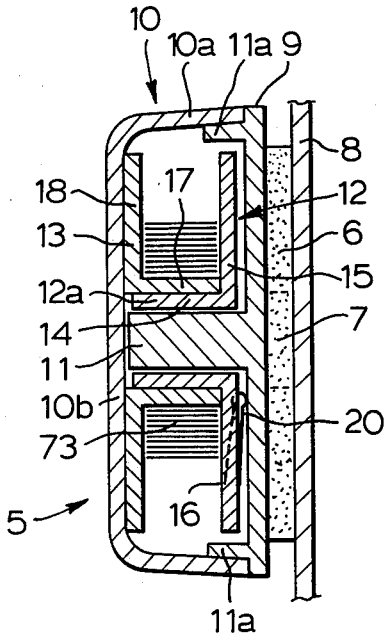
FIG. 2 is a vertical sectional view taken at the line A—A in FIG. 1.

At the far left in FIG. 1, a correction ribbon supply unit 5 is illustrated, the supply unit being elongated as shown. As seen in FIG. 2, the supply unit 5 includes support means constituted by a base plate 9 integral with an outstanding boss 11 and a projecting ledge 11*a*. The projecting ledge 11*a* is spaced slightly inwardly from the outer periphery of the base plate 9.

Also forming part of the supply unit 5 is a housing 10 having side walls 10*a* and a main wall 10*b* spanning between the side walls 10*a*. The marginal portions of the side walls 10*a* are adapted to undergo a press-fit engagement against the projecting ledge 11*a* on the base plate 9, and when assembled, the main wall 10*b* is substantially parallel with the base plate 9.

Mounted for free rotation in the boss 11 within the compartment defined between the housing 10 and the base plate 9 is a supply spool 12 which includes an inner moulding 12*a* and an outer moulding 13. As can be seen, the inner moulding 12*a* includes a cylindrical portion 14 and a flange portion 15, while the outer moulding 13 likewise includes a cylindrical portion 17 and a flange portion 18. The two cylindrical portions 14 and 17 are designed to achieve a press fit together, for ease of assembly.

Figure 6:
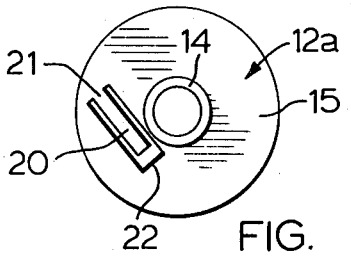
FIG. 6 is a view of one component of this invention.

It is intended that there be a frictional drag opposing rotational movement of the supply spool 12 within the compartment defined between the housing 10 and the base plate 9, the frictional drag occurring between the housing 10 and the flange portion 18 of the outer moulding 13 of the supply spool 12. To provide the force required to create such frictional drag, the inner moulding 12*a* of the supply spool 12 is provided with a dog member 20 as seen in FIGS. 2 and 6, the dog member 20 being integral with the flange portion 15 at the location 21 and being adapted to move resiliently within a window 22 provided in the flange portion 15. The dog member 20 has an "at-rest" position in which it is out of alignment with the flange 15, and protrudes to the side of the flange 15 which is remote from the cylindrical portion 14. The degree of protrusion is such that, when the supply spool 12 is fitted on the boss 11 and the housing 10 is press-fit into place against the base plate 9, the dog member 20 bears resiliently against the inside surface of the base plate 9, thus promoting the frictional drag referred to above.

As can be seen in FIG. 1, a first double-sided adhesive strip 24 is adhered to the outer surface of the base plate 9 at the near end thereof as seen in the Figure, while a second double-sided adhesive strip 26 is provided at the far end. In the application of this apparatus to a typewriter, the far end of the supply unit 5 as seen in FIG. 1 is the end furthest from the front of a typewriter.

Figure 5:
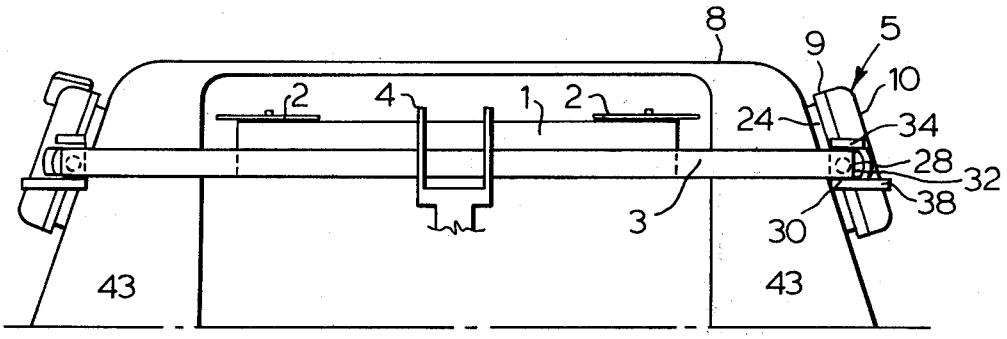
FIG. 5 is an elevational view of a typewriter seen from the back, with the attachment of this invention affixed thereto.

FIG. 5 shows the supply unit 5 adhered to the typewriter cover 8 by means of the double-sided strips.

The back end of the supply unit 5 (the farther end as seen in FIG. 1, and facing the viewer in FIG. 5) defines an opening 28 which is preferably substantially semi-circular in configuration, in order to allow the unrestricted passage of the correction ribbon regardless of the orientation thereof.

Figure 4:
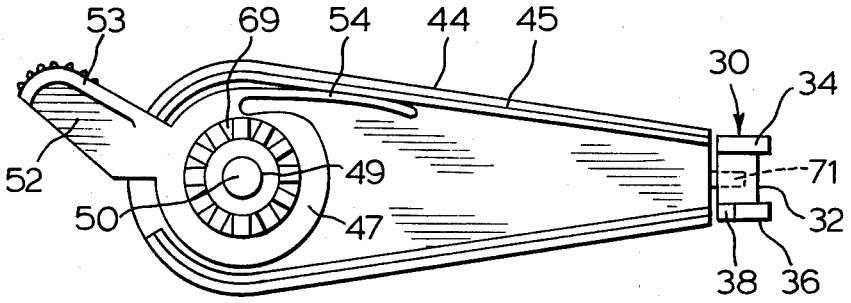
FIG. 4 is an elevational view of one component of this invention, with the cover and spool removed.

Due to the great variation in the outer configuration of conventional typewriters, particularly as regards the angle at which the side walls are set, there will be many instances when the supply unit 5 can be affixed to the side wall of a typewriter cover only at an oblique angle with respect to the vertical. A typical typewriter of this kind is illustrated in FIG. 5. Because the obliquity of the mounting angle can vary widely, it is of advantage to provide ribbon guide means capable of rotating to compensate for the obliquity of the supply unit itself. Such a guide means is illustrated in FIGS. 4 and 5 as a component 30 which includes a guide edge 32 around which the correction ribbon is intended to pass, a retaining ledge 34 at the upper end of the guide edge 32 which keeps the correction ribbon from slipping upwardly off the guide edge 32, another retaining ledge 36 at the lower end of the guide edge 32, and an alignment finger 38 which projects to the right in FIG. 5 and is used by the typist to set the proper position of the component 30 by setting the finger 38 parallel with the table or desk surface. As can be seen in FIG. 5, the finger 38 forms a right angle with the guide edge 32.

The numerals utilized for the parts of the component 30 in FIGS. 4 and 5 are identical even though the components 30 in the two figures are for different respective units (the supply unit and the take-up unit). The components 30 themselves are identical but reversed in the mirror-image sense.

Attention is now directed to the rightward portion of FIG. 1, which shows the take-up unit 40 in perspective, this unit being substantially identical in general configuration with the supply unit 5, it being understood that the two units are reversed in the mirror-image sense. It is intended that the take-up unit 40 be adhered by means of double-sided adhesive strips to the other or opposite side of the cover of the typewriter to which the apparatus is attached.

Figure 3:
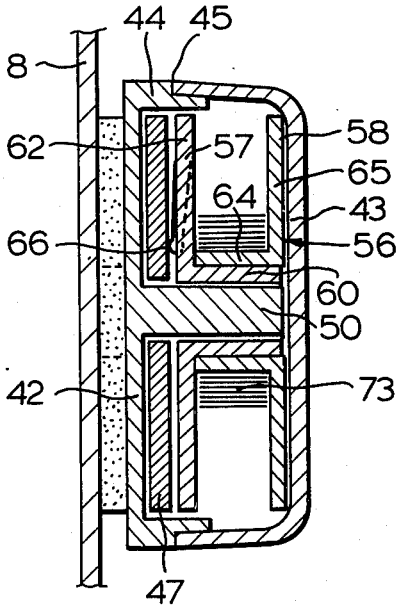
FIG. 3 is a vertical sectional view taken at the line B—B in FIG. 1.

As particularly well seen in FIG. 3, the take-up unit has a slightly larger inside compartment defined between a base plate 42 and a housing 43. Unlike the base plate 9, the base plate 42 has a short upstanding side wall 44 which is indented at 45 to allow the housing 43 to engage the same with a press-fit and present a smooth outer surface. The presence of the side wall 44 raises the housing 43 slightly further away from the base plate 42, and the extra volume in the compartment thus defined is required for the presence of an indexing member 47 which can be seen in section in FIG. 3, and in elevation in FIG. 4.

The indexing member 47 has a central opening 49 adapted to receive a boss 50 integral with the base plate 42. As seen in FIG. 4, the indexing member 47 has an integral, radially extending lever arm 52 which has a flange 53 extending normally to the paper in FIG. 4, and constituting a key which can be engaged by the finger of the typist. The shape of the flange 53 is best seen in FIG. 1.

The indexing member 47 further includes an integral resilient finger 54 which extends obliquely with respect to a radial line drawn from the opening 49, and which is adapted to bear resiliently against the upper part of the side wall 44 of the base plate 42.

Attention is now briefly directed again to FIG. 3 which shows the take-up spool 56 to have exactly the same construction as the supply spool 12. The take-up spool 56 thus includes an inner moulding 57 and an outer moulding 58. The inner moulding 57 includes a cylindrical portion 60 and a flange 62, while the outer moulding 58 includes a cylindrical portion 64 and a flange portion 65. The flange portion 62 includes a dog member 66 identical to the dog member 20 shown in FIG. 6. In the take-up unit, however, the dog member 66 constitutes a drive dog which is adapted to interact with a plurality of ratchet teeth 69 arranged in a concentric ring on the indexing member 47, these being best seen in FIG. 4. The ratchet teeth 69 are shaped and adapted to snag the dog member 66 (the drive dog) of the take-up spool when the indexing member 47 rotates in one direction with respect to the take-up spool, and to slip past the dog member 66 when the indexing member 47 rotates in the opposite direction with respect to the take-up spool. The shape and resilience of the finger 54 which is integral with the indexing member 47 is such as to bias the lever arm 52 always to the uppermost position as illustrated in FIG. 4. When the typist presses downwardly on the lever arm 52, the ratchet teeth 69 rotate in the direction adapted to snag the dog member 66. Thus, downward pressure on the lever arm 52 causes the take-up spool to rotate positively in the counter-clockwise sense as seen in FIG. 4, and it is to be understood that the correction ribbon is wound on the take-up spool in such a way that counter-clockwise motion as viewed in FIG. 4 will cause the tape to be pulled into the take-up unit.

As previously mentioned, the take-up unit also includes guide means defining a guide edge around which the correction ribbon is entrained. The guide means is identical to, but mirror-reversed from, the guide means described previously in connection with the supply unit 5. Both of the components 30 which define the guide edges are adapted to be pivotally and frictionally mounted on a projecting stub shaft 71 which is integrally formed with the respective base plates of the two units. The stub shaft can be seen in FIG. 4.

The wound layers of the correction ribbon can be seen in FIGS. 2 and 3, identified by the numeral 73.

Because the spools are a free fit on the bosses 11 and 50, and since the housings 10 and 43 are a light press-fit against the respective base plates, the typist can easily remove the housings and change spools without concern that loose parts will fall out and become lost. It is contemplated that a clear plastic leader would be attached to the end of the correction ribbon in order to assist in threading it through the typewriter ribbon guide 4.

In use, the attachment of this invention would be operated as follows. The typewriter is first backspaced one step, and the colour change key is shifted to "red". The mistaken letter is again typed, and the letter is impressed through the correction ribbon which causes the erroneous typed letter to be erased. Then, the colour key is shifted back to "black", the backspace key is again depressed one step, and the correct letter is typed in. Next, the correction tape indexing member 47 is depressed once to position a fresh portion of the correction ribbon for the next mistake. Typing can then continue.

It is to be noted that the foregoing simple sequence in one in which the fingers at no time leave the keyboard. The attachment merely provides one additional key for advancing the correction ribbon.

I claim:

1. Apparatus for use with a typewriter, comprising:

a first support means supporting a first spool for holding correction ribbon, the spool being mounted for rotation with respect to the first support means, first attachment means permitting the first support means to be affixed to the outer cover of a typewriter at one side thereof, a first ribbon guide pivotally mounted on said first support means, and having a first guide edge around which the ribbon can bend, whereby the orientation of said first guide edge can be manually determined, the first ribbon guide having visible alignment means to allow the user to know when the first guide edge is oriented perpendicular to a table surface supporting a typewriter to which the apparatus is affixed, a second support means supporting a second spool for receiving correction ribbon, the second spool being mounted for rotation with respect to the second support means, an indexing member adapted positively to rotate the second spool by increments, second attachment means permitting the second support means to be affixed to the outer cover of a typewriter at the other side thereof, and a second ribbon guide pivotally mounted on said second support means, and having a second guide edge around which the ribbon can bend, whereby the orientation of said second guide edge can be manually determined, the second ribbon guide having visible alignment means to allow the user to know when the second guide edge is oriented perpendicular to a table surface supporting a typewriter to which the apparatus is affixed, each said support means including a housing which defines a protective compartment containing the respective spool, the correction ribbon having access to and egress from each compartment through an opening configured to allow unrestricted movement of the ribbon therethrough regardless of the angular orientation of the ribbon with respect to the housing, the respective guide edge for each support means being located outside of but adjacent to the respective said opening;

each said visible alignment means being constituted by an alignment finger extending perpendicular to the respective guide edge, whereby the alignment finger when oriented parallel to a table surface ensures that its respective guide edge is perpendicular to the table surface;

each ribbon guide being frictionally mounted to its respective support means such that it will remain in any orientation until torque is applied to change the orientation.

2. The invention claimed in claim 1, in which each spool has an integral, resilient dog member which has an unstressed position in which it protrudes outwardly from one face of the respective spool, the dog member of the first spool causing the first spool to be urged into frictional contact with a wall of its respective compartment, the dog member of the second spool constituting a drive dog, the said indexing member being mounted concentrically with the second spool for free pivotal movement with respect to both the respective housing and the second spool, the indexing member having concentrically arranged ratchet teeth shaped and adapted to snag the drive dog of the second spool when the indexing member rotates in one direction with respect to the second spool, and to slip past the drive dog when the indexing member rotates in the opposite direction with respect to the second spool.

3. The invention claimed in claim 2, in which each ribbon guide means includes an element having a pivoting friction mount on the respective support means, the element defining the respective guide edge and having an alignment finger perpendicular to the guide edge, whereby the alignment finger when oriented parallel with a table surface ensures that the guide edge is perpendicular to the table surface.

4. The invention claimed in claim 3, in which the indexing member has an integral resilient finger adapted to bear against an inside wall of its respective compartment and to bias the indexing member in the rotational sense opposite to that which causes the drive dog to be snagged by said ratchet teeth.

5. The apparatus claimed in claim 1, in which each said attachment means is constituted by two lengths of double-faced adhesive tape applied to the respective support means at separated locations.

* * * * *